US006155441A

United States Patent [19]

Andersen et al.

[11] Patent Number: 6,155,441

[45] Date of Patent: Dec. 5, 2000

[54] LOCKING PIN MECHANISM FOR RACK AND SHELF SYSTEMS

[76] Inventors: Bob R. Andersen, 1140 Vienna; Raymond Dean Bender, 1542 Burgundy; Dennis A. Schimke, 35 Genie Way, all of Lodi, Calif. 95242; Raymond D. Blumer, 2400 Ives, Redondo Beach, Calif. 90278

[21] Appl. No.: 09/123,272

[22] Filed: Jul. 28, 1998

[51] Int. Cl.[7] ..... A47B 43/00

[52] U.S. Cl. ..... 211/192

[58] Field of Search ..... 211/192; 108/146; 297/377; 411/341, 343, 347; 292/10, 20, 60, 164, 175, DIG. 47; 267/91, 99, 166, 167

[56] References Cited

U.S. PATENT DOCUMENTS

| | | | |
|---|---|---|---|
| 1,061,509 | 5/1913 | Troetel | 292/60 |
| 1,394,513 | 10/1921 | Albonesi | 292/60 |
| 1,471,187 | 10/1923 | Morgner | 292/DIG. 47 |
| 1,888,478 | 11/1932 | Steidl | 108/146 |
| 3,042,221 | 7/1962 | Rasmussen | 211/148 |
| 3,059,736 | 10/1962 | Boyd | 411/347 |
| 3,144,945 | 8/1964 | Seiz . | |
| 3,321,229 | 5/1967 | Eckel | 292/60 |
| 3,351,212 | 11/1967 | McConnell | 211/192 |
| 3,362,738 | 1/1968 | Dygert et al. . | |
| 3,388,809 | 6/1968 | Irish . | |
| 3,545,626 | 12/1970 | Seiz | 211/192 |
| 3,702,137 | 11/1972 | Evans | 211/192 |
| 4,165,854 | 8/1979 | Duly . | |
| 4,243,342 | 1/1981 | Marto . | |
| 4,257,193 | 3/1981 | Williams | 49/465 |
| 4,262,809 | 4/1981 | McConnell . | |
| 4,286,810 | 9/1981 | Ehmen | 292/67 |
| 4,339,148 | 7/1982 | Smith et al. . | |
| 4,496,061 | 1/1985 | Highsmith | 211/192 X |
| 4,602,890 | 7/1986 | Duda . | |
| 4,635,327 | 1/1987 | Netznik . | |
| 4,921,287 | 5/1990 | Horvath et al. | 292/106 |
| 4,972,783 | 11/1990 | Crissman et al. . | |
| 5,131,781 | 7/1992 | Klein | 211/192 X |
| 5,237,791 | 8/1993 | Scanlan . | |

*Primary Examiner*—Daniel P. Stodola
*Assistant Examiner*—Curtis A. Cohen
*Attorney, Agent, or Firm*—R. Michael West; Boutin, Dentino, Gibson, DiGusto, Hodell & West

[57] ABSTRACT

A locking mechanism for a plurality of interconnected beam members and upright members used in a rack or shelf system. For rack assembly, headed lugs on beam ends are slid into selected key-hole slots on the uprights. The locking mechanism uses a spring-loaded, captive pin translatable from a locked position to an unlocked position, and rotatable from an enabled position to a disabled position. When enabled and urged into a locked position, the pin enters an upper portion of the key-hole, vacated by the lug head when the beam and uprights are interconnected. The pin thereby prevents the lug head from being removed from the key-hole. Both automatic and manual operation of the locking mechanism is possible.

20 Claims, 5 Drawing Sheets

LOCKING PIN MECHANISM FOR RACK AND SHELF SYSTEMS

BACKGROUND OF THE INVENTION

1. Field of the Invention

The invention pertains generally to heavy duty, commercial storage racks, usually found in warehouses, distribution centers, and home improvement centers. More specifically, the invention relates to a locking pin mechanism for automatically or manually locking beams, posts, or other structural members which comprise rack or shelf systems.

2. Description Of The Prior Art

Prior art racks for storing palletized goods typically include a plurality of horizontal beams, upright posts, and plywood sheets. Pairs of the horizontal beams are spaced in vertical relation and interconnected at each end to a respective upright post. Horizontal and angled cross braces are usually provided between the end pairs of upright posts, for additional rigidity. The paired beams are parallel and horizontally spaced so they can support a plywood sheet, forming a rack or shelf upon which items pan be stored and displayed.

For example, in U.S. Pat. No. 4,972,783, a structure for adjustable shelving is shown. U-shaped uprights include a plurality of apertures spaced in vertical relation along their sides. Each end of a horizontal beam has a J-shaped cap, adapted to engage one side of the upright. Each beam end also includes at least one spring-loaded shotpin, for engaging a selected aperture in an upright. Once all the beams are engaged with respective uprights at the selected heights, a shelf is placed over and supported by each corresponding pair of beams.

Another popular pallet rack system includes rows of key-hole shaped slots in the uprights. For engaging the uprights, the beams include right-angled endplates, typically fitted with a number of headed lugs. The lugs are sized initially to pass through a larger, upper portion of the key-hole. Then, the beam and the associated endplate are urged downwardly, and the lugs nest within a smaller, lower portion of their respective key-holes. The lower portion of the key-hole engages abutting surfaces of the lug head, preventing outward movement of the lug and the attached beam.

However, if the aforementioned rack system lacks an auxiliary beam locking mechanism, assembly of the rack can be difficult. During assembly, the pallet structure is awkward to handle, and somewhat flimsy until a number of beams and uprights are connected. Because there are no downward, loading forces on the beams, the lugs may inadvertently be dislodged from the key-hole, causing unexpected separation of the beams and uprights. And, even after the rack is fully assembled, safety issues can arise. If upward, vertical forces are applied to the beam, the lugs can easily be urged out of the key-holes, disengaging the beam and the upright. For example, serious accidents have occurred when loads have been moved onto or off of the rack, and a forklift operator accidentally lifts a beam out of engagement with its respective upright.

An example of a beam locking mechanism is shown in U.S. Pat. No. 4,262,809, issued to Mc Connell. This reference teaches a "loadlock" assembly, in each end of the beam of a pallet rack structure. The loadlock includes a right-angled bolt, slidable within an elongated, contoured slot in the sidewall of an end of the beam. The bolt carries a retainer, made of spring metal, which projects through the contoured slot. The bolt may selectively moved into three different positions: a shipping position; a loading position; and, a locked position.

However, the slidable resistance of the bolt, retainer, and slot assembly in Mc Connell is such that a hammer or other tool is necessary to move the bolt from a locked position to a shipping position. In fact, the relative difficulty of moving the bolt is identified as an advantage of the locking mechanism. Moreover, the components and structures of Mc Connell's loadlock mechanism are relatively expensive to manufacture and difficult to assemble.

The need still exists, then, for a locking mechanism which is simple and inexpensive to manufacture and assemble, yet effective and positive in preventing accidental and unexpected separations of structural members in rack and shelf systems.

The need also exists for a locking mechanism between structural members which can be manipulated easily by hand, from an enabled mode to a disabled mode.

The need also exists for a locking mechanism between structural members which can be manipulated easily by hand, from a locked position to an unlocked position.

The need further exists for a locking mechanism which will automatically extend into a locked position, during assembly of structural members such as beam and upright components comprising a pallet rack system.

SUMMARY OF THE INVENTION

One unique aspect of the locking mechanism disclosed herein, is its location. The locking mechanism is mounted on the outwardly facing portion of an end plate welded to the extremity of each beam structural member. This location allows direct, easy access by the assembler, so the movable locking pin assembly can be grasped and manipulated as needed.

Another unique feature is the manner in which the locking pin may be moved, to effect different operations. The locking pin assembly may be translated for engagement and disengagement with the upright structural member. The locking pin may also be rotated from an enabled position to a disabled position.

Yet another unique feature of the locking mechanism is where and how, the spring-loaded locking pin engages the upright. In the present invention, the locking pin engages the larger, upper portion of an upright's key-hole, or slot. In one mode of operation, the locking pin automatically effects this engagement as the beam member is lowered into locked position with the upright member. In another mode of operation, the locking pin may manually be slid into engagement with the key-hole, after the beam and upright have already been secured together.

The locking mechanism comprises a locking pin, a spring, a captivator clip, and a connector rivet, or lug. The captivator clip has a flat base, or foot portion and an outwardly extending U-shaped portion. In the preferred embodiment, the connector rivet secures the foot of the captivator clip to the end plate of the beam. The U-shaped portion of the captivator clip includes an aperture through which an outer shank of the locking pin passes.

The locking pin has several diameters along its length, ranging from a larger, inner shank to the smaller, outer shank. An annular shoulder, machined around the pin, is located between the inner and outer shanks. The spring is installed over the outer shank of the pin, and is secured between the shoulder and the underside of the captivator clip. The spring provides an inward bias on the pin, toward a locked position. A bore is provided in the end plate, adjacent the clip's connector rivet. The inner shank of the spring-loaded pin passes through the bore.

A U-shaped cap is secured to the outermost end of the locking pin, allowing the user to move the locking pin into various rotational and translational positions. The longitudinal dimension of the cap with respect to the underlying portion of the captivator clip, permits the locking mechanism to be enabled or disabled. This is accomplished by merely retracting the cap slightly from the captivator clip, and rotating the cap 90 degrees from its former position. If the mechanism is in an enabled position, the cap and the locking pin may freely be translated, into a locked or unlocked position. However, when the cap is retracted and rotated into a disabled position, the spring load maintains the cap ends against the captivator clip. With the cap secured in this position, the locking pin is fully retracted from the key-hole of the upright, thereby unlocking the mechanism.

A second embodiment of the invention is also disclosed herein. Very similar to the first embodiment, the second embodiment uses a C-clip in combination with an annular groove in the locking pin. This structural combination is used in lieu of the aforementioned machined shoulder, and performs the identical function. The C-clip, secured within the annular groove, forms a ring-like structure around the locking pin against which the inner end of the spring abuts. In all other significant respects, the structure and operation of the first and second embodiments are identical.

DETAILED DESCRIPTION OF THE PREFERRED EMBODIMENT

Figure 1:
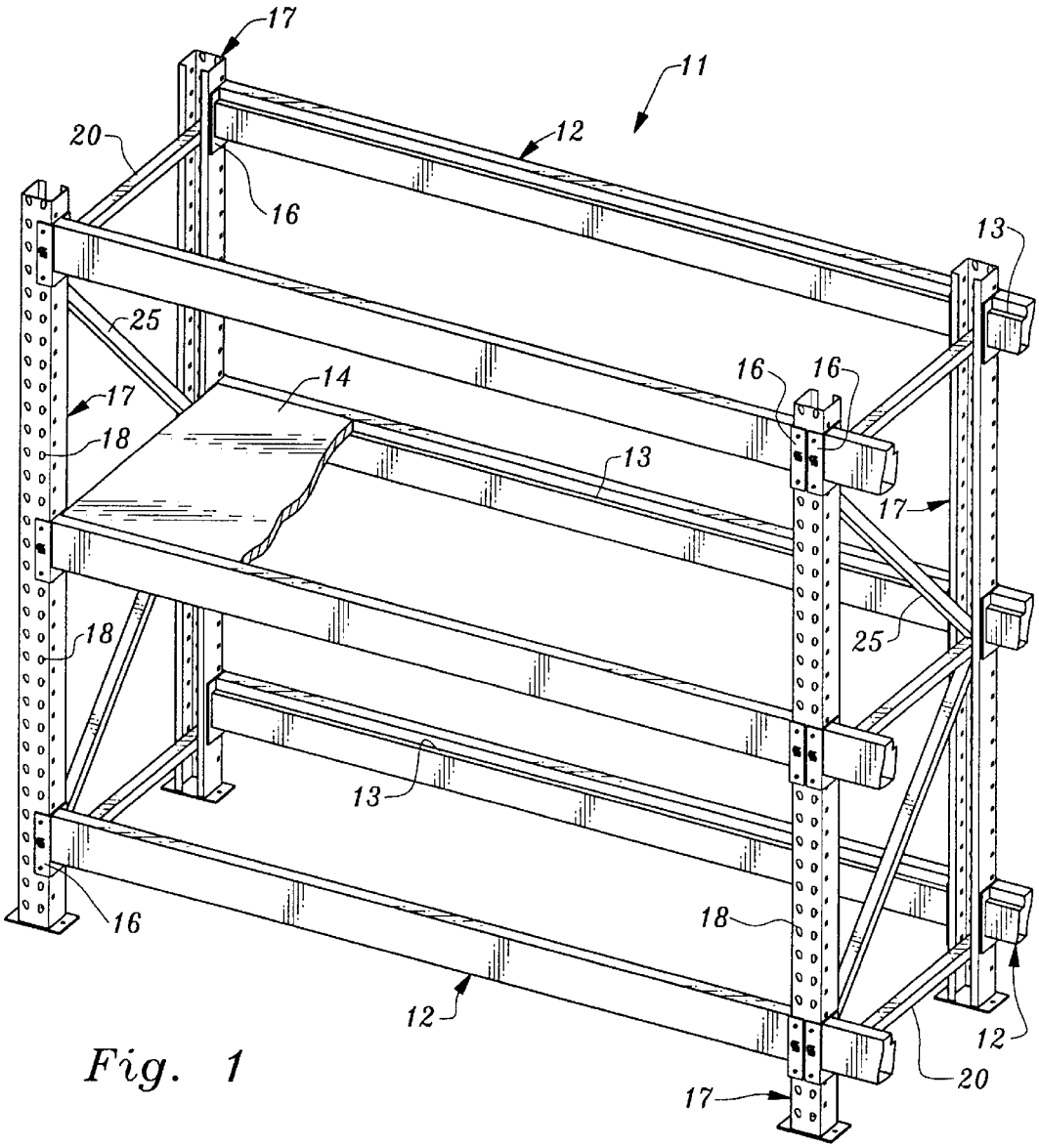
FIG. 1 is a right front perspective of a pallet rack system, including the locking mechanism of present design.

Turning now to FIG. 1 of the drawings, a pallet rack 11 includes a plurality of horizontally spaced, parallel pairs of beam members 12. A channel 13, or ledge may be provided along the full extent of each beam. This channel is sized to accommodate and edge-support a shelf 14, typically made of plywood or other manufactured wood product. Alternatively, if the beam members 12 include no channel 13, shelf 14 rests directly upon the upper faces of the members 12.

Right-angled end plates 16 are welded to the ends of each beam member. Each end plate abuts and engages a respective upright member 17, or post. Horizontal cross braces 20 and angled cross braces 25, are included to provide further rigidity and strength to the rack assembly.

Figure 2:
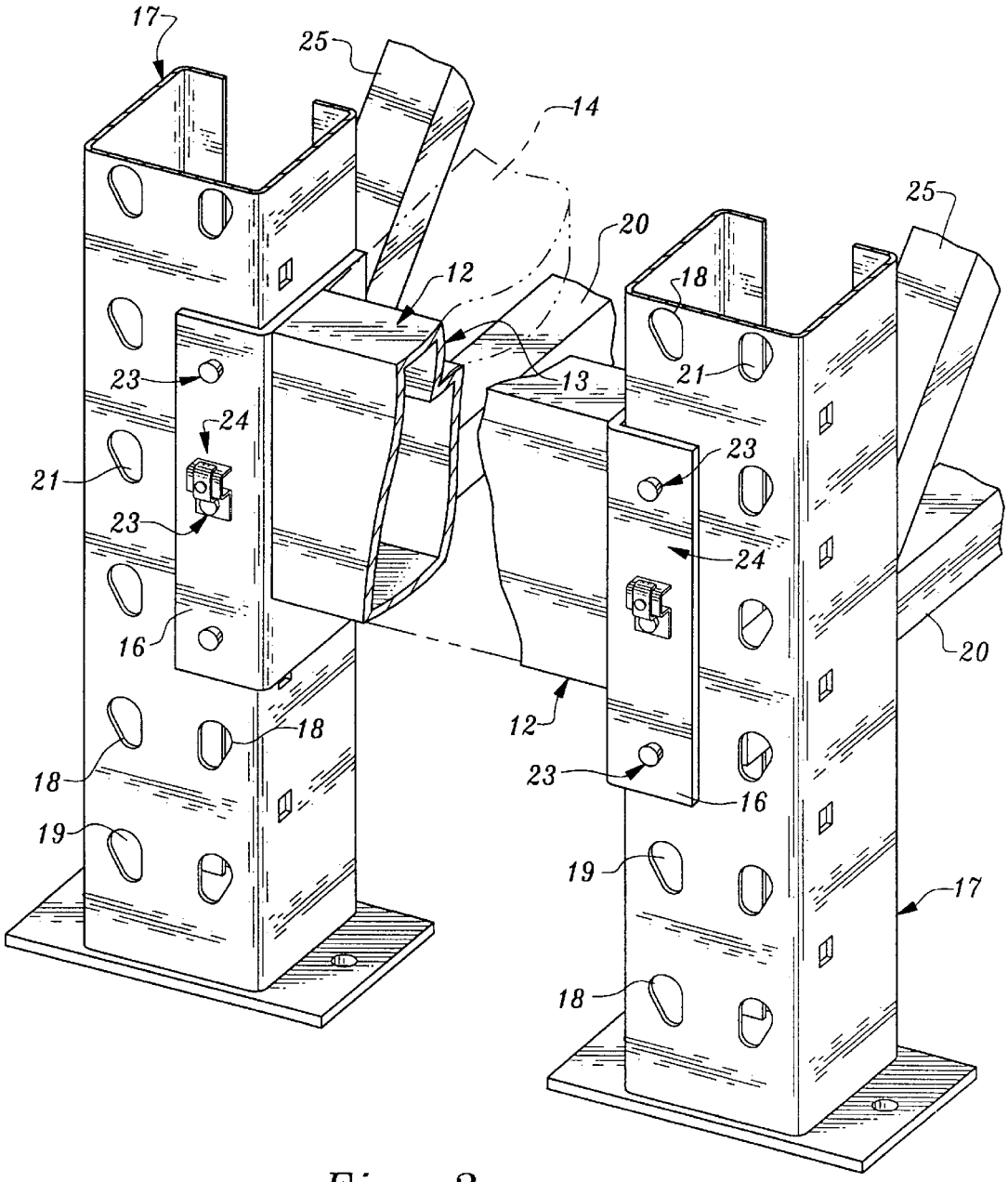
FIG. 2 is a fragmentary perspective view of two uprights in combination with respective beam end plates, including two of the locking mechanisms.

As shown particularly in FIG. 2, each upright 17 includes vertical rows of key-holes 18, or slots. Each key-hole 18 has a larger, upper portion 19 and a smaller, lower portion 21. The size and contour of the key-hole are designed to accommodate a head 22 on a lug 23, also known as a connector rivet. In a manner to be explained herein, these lugs are used to interconnect beam members 12 with upright members 17.

Three lugs 23 are used on each of the end plates 16. The upper and lower lugs are riveted directly to the end plates, whereas an intermediate lug is riveted both to the end plate and to a locking pin mechanism 24. The precise number of lugs used is a matter of design choice, ranging from one to five, or so, depending upon size and strength requirements. Also, it is a matter of convenience, not necessity, to have the locking pin mechanism secured in place by means of a lug rivet.

Figure 6:
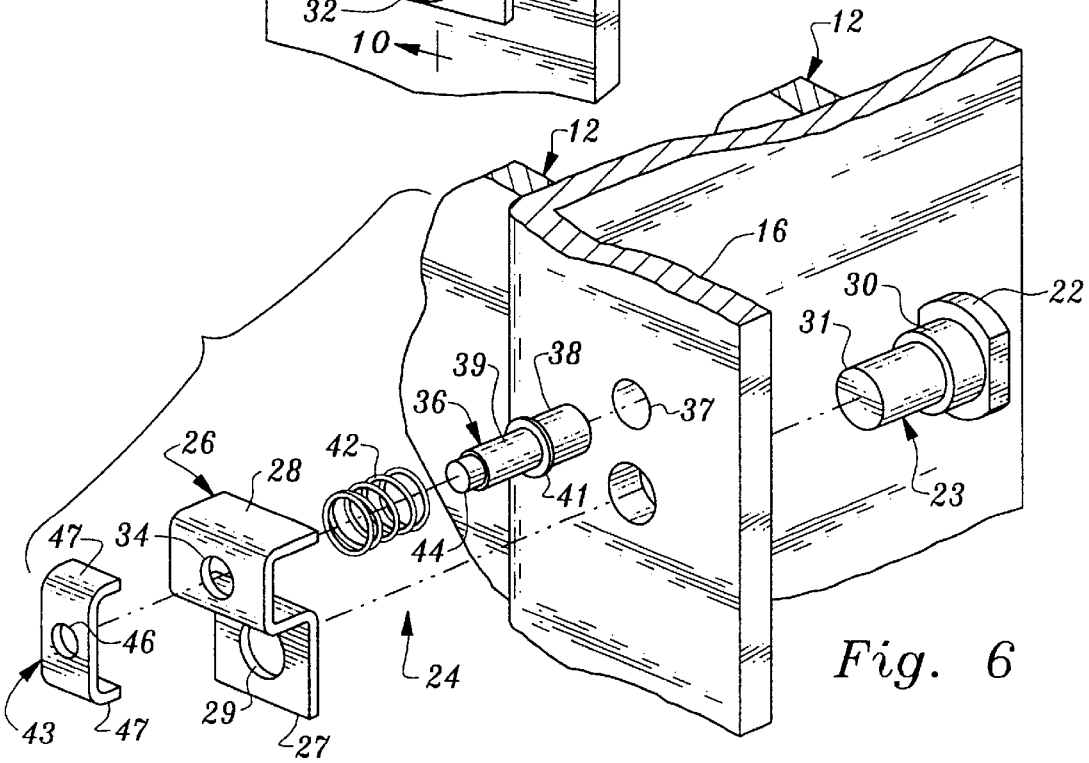
FIG. 6 is a fragmentary, exploded perspective view of the locking mechanism of present design, in combination with a pallet beam end plate.
Figure 9:
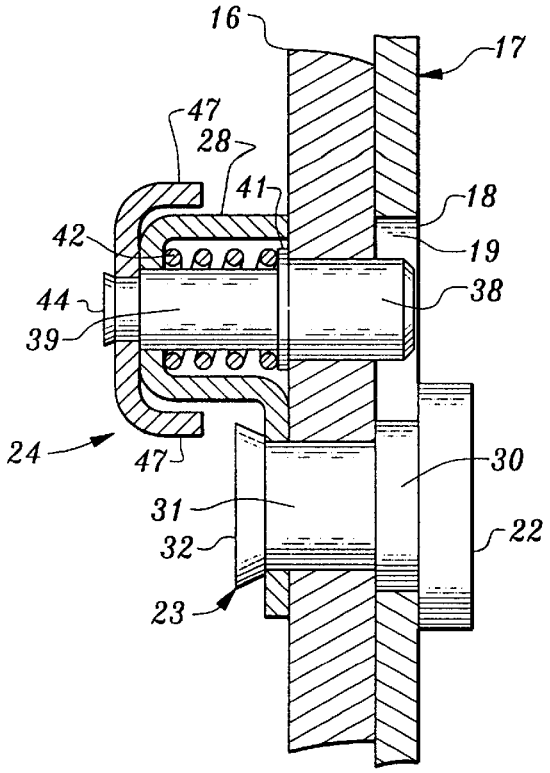
FIG. 9 is a fragmentary, cross-sectional view of the locking mechanism in an engaged, and locked position, taken on the line 9—9, in FIG. 3.
Figure 10:
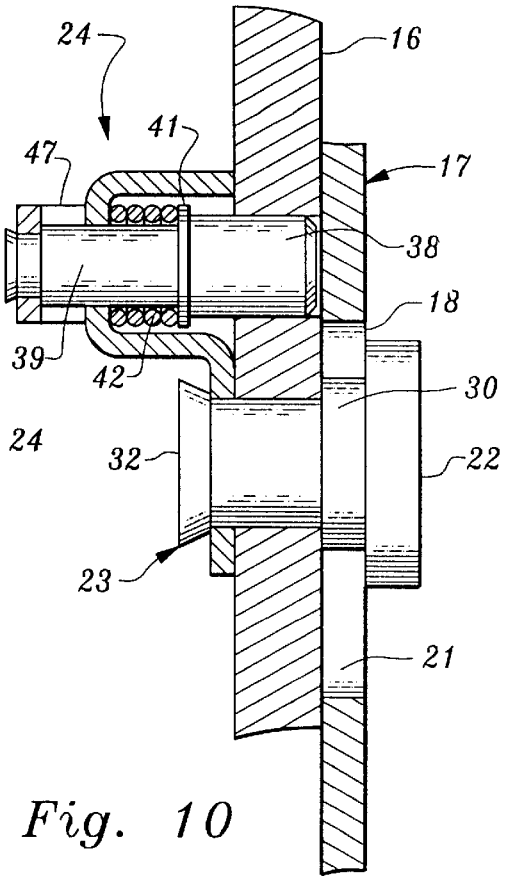
FIG. 10 is a fragmentary, cross-sectional view of the locking mechanism in a disengaged, unlocked position, taken on the line 10—10, in FIG. 5; and, FIG. 11 is a fragmentary, exploded perspective view of a second embodiment of the present locking mechanism.

FIG. 6 shows the major components of mechanism 24. A captivator clip 26 includes a foot 27, or base, and an outwardly extending U-shaped portion 28. Foot 27 includes a hole 29 through which a shaft 31 of lug 23 passes. When compressive forces are applied to the end of shaft 31, a flattened head 32 is formed, securely fastening the clip and mechanism 24 to the plate 16. Lug 23 also includes a shoulder portion 30, so that when the lug is riveted into place, opposing surfaces of head 22 and plate 16 are spaced apart a distance slightly greater than the thickness of the metal forming upright 17 (see, FIGS. 9 and 10).

U-shaped portion 28 includes a rectangular face 33 having an aperture 34 therethrough. Movable locking pin 36 passes both through aperture 34 and through a bore 37 within end plate 16. Pin 36 has an inner shank 38 and a smaller outer shank 39. An annular shoulder 41 is located on pin 36, between shanks 38 and 39. When pin 36 is manufactured, it may be machined to form the various shank portions and the shoulder. A spring 42 is located over the outer shank 39 of the pin, and is secured between the shoulder and the underside of the captivator clip 26.

A gripable U-shaped cap 43 is secured to an outermost end 44 of the locking pin 36. End 44 passes through a hole 46, and is compression riveted over cap 43. Cap 43 allows the user to manipulate the locking pin into various rotational and translational positions. It should be noted that cap 43 has a longitudinal dimension which bears an important relationship with respect to the longitudinal and transverse dimensions of underlying rectangular face 33, of the captivator clip 26. The referenced longitudinal dimension of cap 43 is measured between the inner, opposing faces of legs 47.

Figure 3:
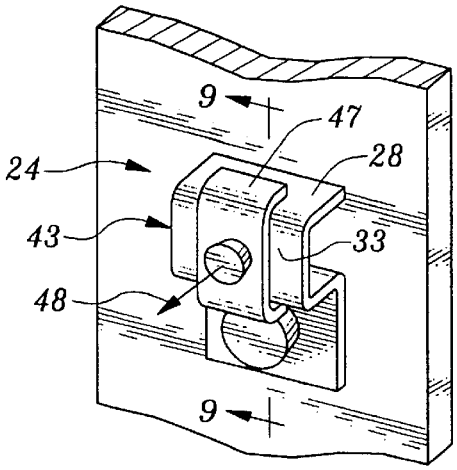
FIG. 3 is a detail inset view of the enabled locking mechanism in a fully extended, and locked position.

This dimensional relationship between cap 43 and clip 26 permits the operation of the locking mechanism 24 to be enabled or disabled. For example, in FIGS. 3 and 9, the mechanism is enabled, as the longitudinal dimension of cap 43 is greater than the transverse dimension of face 33. Legs 47 of cap 43 can thereby slide over the sides of U-shaped portion 28, allowing spring 42 to translate locking pin 36 into a fully extended, locked position. By gripping the cap 43 and drawing it outwardly, as shown by the directional arrow 48, the pin 36 maybe translated into a fully retracted, unlocked position. It should be noted, however, that at this time the mechanism 24 is still enabled.

Figure 4:
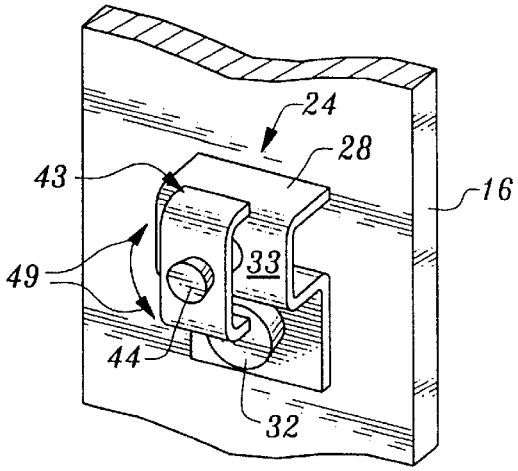
FIG. 4 is a view as in FIG. 3, showing the enabled locking mechanism in a fully retracted position.
Figure 5:
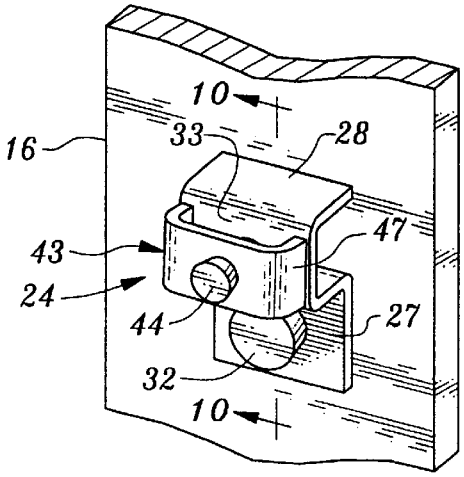
FIG. 5 is a view as in FIG. 3, but showing the locking pin cap rotated 90 degrees, placing the locking mechanism in a disabled, and unlocked position.

As shown in FIG. 4, the cap 43 may then be rotated 90 degrees in either direction, indicated by the directional arrows 49. When cap 43 is subsequently released, the ends of feet 47 rest upon face 33, as the longitudinal dimension of face 33 exceeds the longitudinal dimension of cap 43 (see, FIG. 5). Now, locking pin 36 is in a fully retracted, and unlocked position, and the mechanism 24 is disabled. Even though spring 42 is fully compressed (see, FIG. 10), the position of the cap over the clip is such that the locking pin remains fully retracted.

Figure 7:
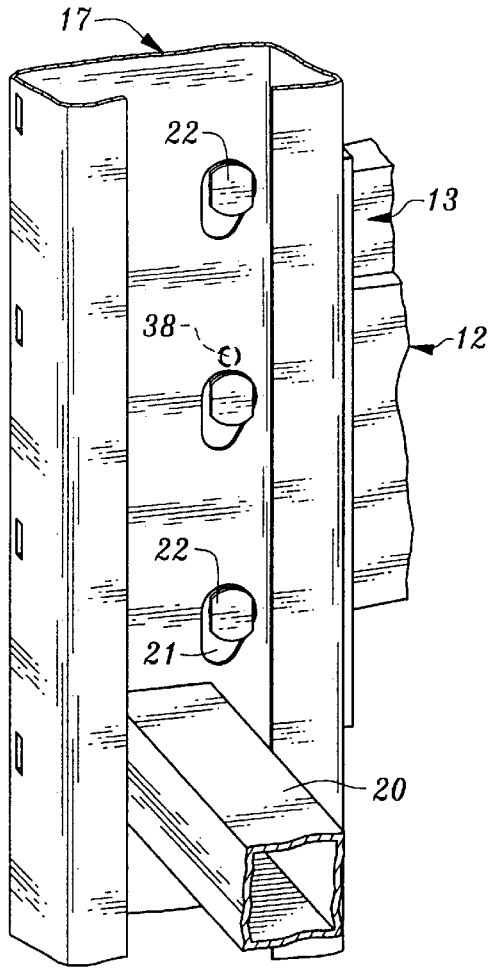
FIG. 7 is a rear, fragmentary perspective view of a beam and an upright in partial engagement, showing the locking pin in broken line and the lug head inserted within the upper portion of the key-hole.
Figure 8:
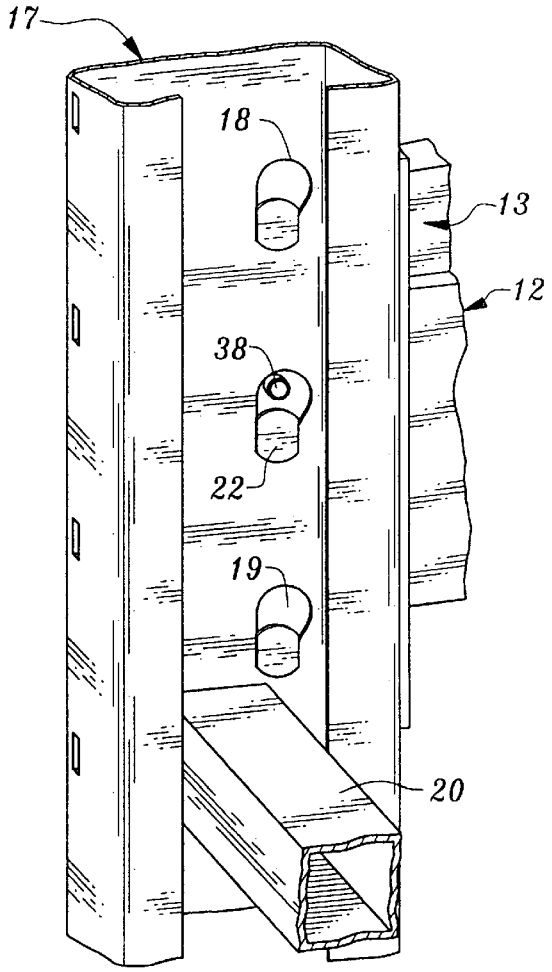
FIG. 8 is a view as in FIG. 7A, but with the beam and the upright in full, locked engagement, showing the locking pin extending within the upper portion of the key-hole and the lug head nested within the lower portion of the key-hole.
Figure 7A:
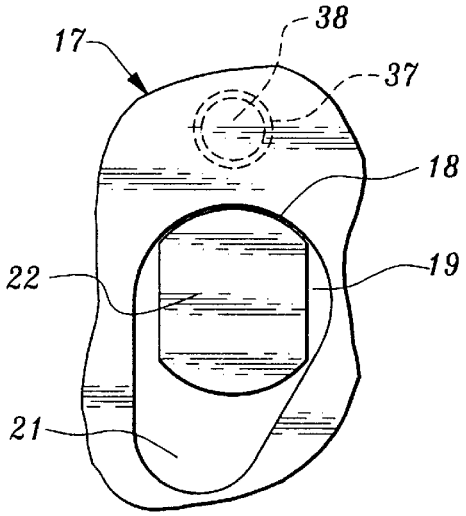
FIG. 7A is a detail inset of FIG. 7, showing the relative positions of the locking pin, the head lug, and the key-hole.

Having explained the structural features of the present invention, we can now turn to an assembly procedure of the beams and uprights so the operational aspects of the locking mechanism will be better appreciated. Making reference to FIGS. 7 and 7A, a beam 12 is positioned at the desired height with respect to upright 17, and heads 22 of the lugs 23, are aligned with and inserted into upper portion 19 of key-hole 18. Locking pin mechanism 24 is enabled, freeing spring 42 to urge or bias locking pin 36 inwardly. As shown in FIG. 7A, inner shank 38 impinges against the adjacent, outer sidewall of upright 17.

Figure 8A:
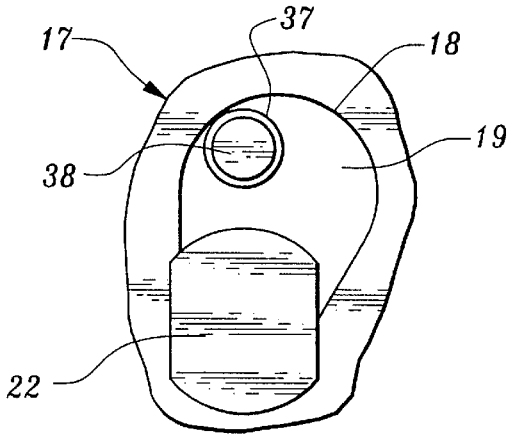
FIG. 8A is a detail inset of FIG. 8, showing the relative positions of the locking pin and the head lug within the key-hole.

In the next step, the assembler urges beam 12 downwardly, causing heads 22 to nest within the lower portion 21 of key-hole 18. Because head 22 has a size and configuration which overlaps and covers the lower portion 21, the lug, end plates, and beam are now secured to the upright 17. Concurrently, spring loaded locking pin 36 has cleared the sidewall of upright 17, and inner shank 38 is translated inwardly to enter upper portion 19 (see, FIGS. 8A and 9). The presence of the inner shank in the key hole prevents the headed lug from being raised. In this manner, the beam and the upright are automatically and positively locked together.

The locking operation can also be manually undertaken, if desired. With the locking mechanism disabled, the assembler first inserts the lugs into the upper portions 19, and then urges the beam downwardly. With the lugs now fully nested in the lower portions 21, the locking mechanism 24 is enabled, and the locking pin is freed to translate inwardly, into a fully extended and locked position within the key hole.

To disassemble the rack 11, or to move a shelf to a different elevation, the operation is reversed. Cap 43 is grasped and pulled outwardly, then rotated 90 degrees. Upon release of the cap, the locking mechanism is now unlocked and disabled. Then, the assembler urges the beam upwardly so that heads 22 of lugs 23, are within the upper portion 19 of key-holes 18. Finally, the beam is retracted or drawn away from the upright, until the heads are free from the key-holes.

It should also be noted that structural members other than horizontal beams and upright posts may be interconnected using the present invention. It is only required that one member is fitted with the locking mechanism and a lug-type structure, and that the other member includes a recess or aperture adapted to receive the lug structure and the locking pin described above. Thus, the present invention may be used to interconnect horizontal, vertical, inclined, or extending members of any rack or shelf system.

Figure 11:
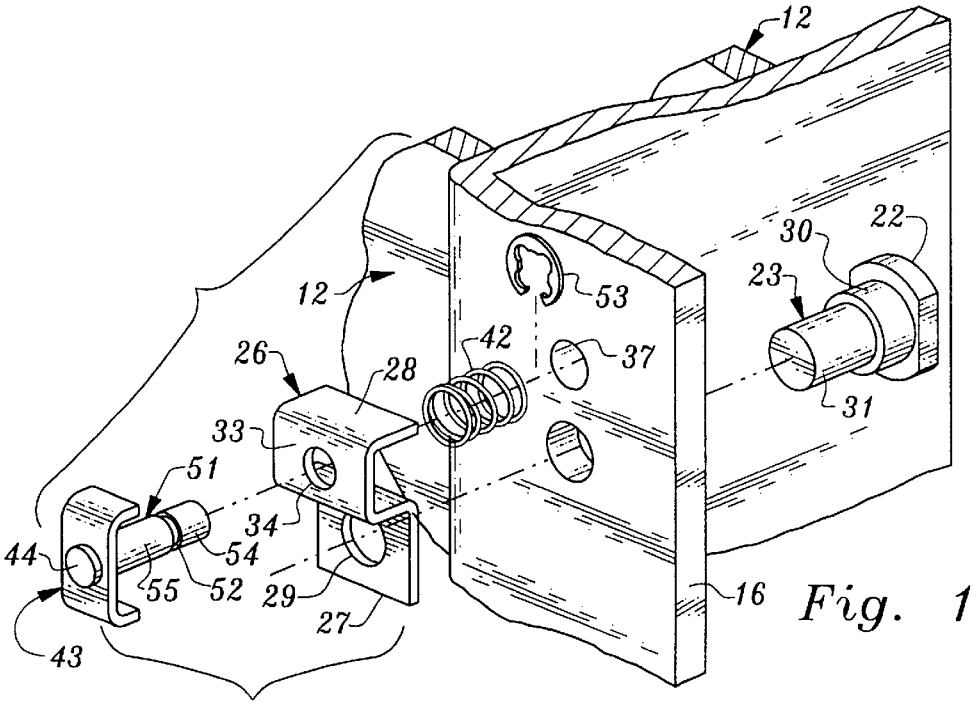

A second embodiment of the invention differs from the first embodiment only in the structure of the locking pin. As illustrated in FIG. 11, a locking pin 51 having an inner shank 54 and an outer shank 55, includes an annular groove 52. A C-clip 53 snaps over the annular groove, providing a shoulder to restrain spring 42 and keep it under constant tension. The structural combination of the C-clip and groove is used in lieu of the aforementioned machined shoulder, and performs the identical function. It should also be noted that the diameter of locking pin 51, other than in the region of the groove, is constant. With these being the only differences in structure, the remainder of the elements of the second embodiment are identical to those previously identified so the same numbering arrangement is used. In addition, the operation of the second embodiment is identical to that previously set forth, so no further explanation of its operation is required.

It will be appreciated, then, that we have disclosed herein two embodiments of a locking mechanism for a rack or shelf system, which is simple in construction and operation, yet provides enabled and disabled modes of operation, in combination with the option of automatic or manual locking procedures.

What is claimed is:

1. A locking mechanism comprising:

a. a captivator clip having a foot portion and a U-shaped portion, said U-shaped portion having a rectangular face with a transverse dimension and a longitudinal dimension, and further having an aperture passing through said rectangular face;

b. a locking pin having an outer shank portion passing through said aperture and an inner shank portion;

c. bias means, for urging said inner shank portion of said locking pin to translate in an inward direction away from said U-shaped portion;

d. a cap attached to an outer end of said locking pin, said cap being U-shaped, having two legs and a longitudinal dimension between inner surfaces of said legs, said longitudinal dimension between said legs being greater than said transverse dimension of said rectangular face and less than said longitudinal dimension of said rectangular face, said cap and said locking pin being rotatable from an enabled position, in which said inner shank can freely translate from a retracted, unlocked position to a fully extended locked position, to a disabled position, in which said inner shank is held fast in a retracted position.

2. The combination of a locking mechanism and a rack or shelf system, said system including a plurality of beams, each end of each of said beams having an end plate with a headed lug for interconnection with a respective upright, each of said uprights including a row of key-holes having a larger upper portion and a smaller lower portion for receiving a respective said lug, said locking mechanism comprising:

a. a captivator clip, having a foot portion and a U-shaped portion, said foot portion being attached to an end plate, and said U-shaped portion extending outwardly from said end plate and having an aperture therethrough, said U-shaped portion having a rectangular face with a transverse dimension and a longitudinal dimension;

b. a locking pin having an outer shank portion passing through said aperture and an inner shank portion passing through a bore in said end plate;

c. bias means, for urging said locking pin to translate in an inward direction toward said bore; and, d. a cap attached to an outer end of said locking pin, said cap being U-shaped having two legs and a longitudinal dimension between inner surfaces of said legs, said longitudinal dimension between said legs being greater than said transverse dimension of said rectangular face and less than said longitudinal dimension of said rectangular face, said cap and said locking pin being rotatable from an enabled position, in which said inner shank can freely translate from a retracted, unlocked position to a fully extended position within said upper portion of a key-hole, to a disabled position, in which said inner shank is held fast in a retracted position withdrawn from said key-hole.

3. An apparatus as in claim 2 in which said bias means includes an annular shoulder on said locking pin between said inner shank and said outer shank, and a spring on said outer shank between said shoulder and a lower surface of said U-shaped portion of said captivator clip.

4. An apparatus as in claim 2 in which said bias means includes an annular groove on said locking pin, a C-clip on said annular groove, and a spring on said locking pin between said C-clip and a lower surface of said U-shaped portion of said captivator clip.

5. An apparatus as in claim 2 in which said foot is attached to said end plate with a first headed lug, and in which during assembly of said end plate with a respective said upright, said first headed lug is initially urged into said upper portion of said key-hole and then urged downwardly into said lower portion thereof.

6. An apparatus as in claim 5 further including a second headed lug mounted on said end plate spaced from said first headed lug, and in which said space between said first and second lug corresponds to a distance between respective said key-holes for receiving said lugs.

7. An apparatus as in claim 2 in which said cap is rotated 90°, to change from an enabled position to a disabled position.

8. An apparatus as in claim 2 in which said cap is rotated 90° to change from a disabled position to an enabled position.

9. A combination of a locking mechanism and a rack or shelf system, said system including a plurality of beams, each end of each of said beams having an end plate with a headed lug for interconnection with a respective upright, each of said uprights including a row of key-holes having a larger upper portion and a smaller lower portion for receiving a respective said lug, said locking mechanism comprising:

a. a captivator clip, having a foot portion and a U-shaped portion, said foot portion being attached to an end plate, and said U-shaped portion extending outwardly from said end plate, said U-shaped portion further having a rectangular face with a transverse dimension and a longitudinal dimension and an aperture therethrough;

b. a locking pin having an outer shank portion passing through said aperture and an inner shank portion passing through a bore in said end plate;

c. bias means, for urging said locking pin to translate in an inward direction toward said bore; and, d. a cap attached to an outer end of said locking pin, said cap being U-shaped, having two legs and a longitudinal dimension between inner surfaces of said legs, said longitudinal dimension between said legs being greater than said transverse dimension of said rectangular face and less than said longitudinal dimension of said rectangular face, said cap and said pin being rotatable, and in which said inner shank can freely translate from a retracted, unlocked position to a fully extended locked position within said upper portion of a key-hole.

10. An apparatus as in claim 9 in which said bias means includes an annular shoulder on said locking pin between said inner shank and said outer shank, and a spring on said outer shank, between said shoulder and a lower surface of said U-shaped portion of said captivator clip.

11. An apparatus as in claim 9 in which said bias means includes an annular groove on said locking pin, a C-clip on said annular groove, and a spring on said locking pin between said C-clip and a lower surface of said U-shaped portion of said captivator clip.

12. An apparatus as in claim 9 in which said foot is attached to said end plate with a first headed lug, and in which during assembly of said end plate with a respective said upright, said first headed lug is initially urged into said upper portion of said key-hole and then urged downwardly into said lower portion thereof.

13. An apparatus as in claim 12 further including a second headed lug mounted on said end plate vertically spaced from said first headed lug, and in which said space between said first and second lug corresponds to a distance between respective said key-holes for receiving said lugs.

14. An apparatuses in claim 9 including means for enabling and disabling the locking mechanism.

15. An apparatus as in claim 14 in which said means for enabling and disabling effects a 90° rotation of said cap.

16. A combination of a locking mechanism and a rack or shelf system, said system including a plurality of beams, each end of each of said beams having an end plate with a headed lug for interconnection with a respective upright, each of said uprights including a row of key-holes having a larger upper portion and a smaller lower portion for receiving a respective said lug, said locking mechanism comprising:

a. a bore in said end plate;

b. a locking pin, having an outer shank and an inner shank, said inner shank being located within said bore;

c. pin captivator means adjacent said bore, for maintaining said locking pin in axial alignment with said bore, during inward and outward translational movement therein, from an extended position within said bore to an retracted position withdrawn from said bore;

d. bias means, for urging said locking pin to translate inwardly within said bore; and, e. cap means attached to an outer end of said locking pin, for limiting the extent of inward travel of said locking pin when said bore is in alignment with an upper portion of a key-hole.

17. An apparatus as in claim 16 in which said bias means includes an annular shoulder on said locking pin between said inner shank and said outer shank, and a spring on said outer shank, between said shoulder and a lower surface of a U-shaped portion of said pin captivator means.

18. An apparatus as in claim 16 in which said bias means includes an annular groove between said inner shank and said outer shank, a C-clip on said annular groove, and a spring on said inner shank between said C-clip and a lower surface of a U-shaped portion of said pin captivator means.

19. An apparatus as in claim 16 in which said pin captivator means has a foot portion and a U-shaped portion, said foot portion being attached to said end plate, and said U-shaped portion having an aperture therein in axial alignment with said bore and through which said outer shank of said pin slidably translates.

20. An apparatus as in claim 19 in which said U-shaped portion of said pin captivator means has a rectangular face with a transverse dimension and a longitudinal dimension, and in which said cap means is U-shaped, having two legs and a longitudinal dimension between inner surfaces of said legs, said longitudinal dimension between said legs being greater than said transverse dimension of said rectangular face and less than said longitudinal dimension of said rectangular face.

* * * * *